United States Patent [19]

Randall

[11] Patent Number: 4,821,892

[45] Date of Patent: Apr. 18, 1989

[54] SHELVING SYSTEM

[75] Inventor: Harold M. Randall, Fullerton, Calif.

[73] Assignee: Newell Co., Freeport, Ill.

[21] Appl. No.: 228,197

[22] Filed: Aug. 3, 1988

Related U.S. Application Data

[63] Continuation of Ser. No. 1,341, Jan. 8, 1987, abandoned.

[51] Int. Cl.[4] ..... A47F 5/08

[52] U.S. Cl. ..... 211/90; 248/250; 108/108

[58] Field of Search ..... 211/90, 87, 88, 134, 211/153, 162, 94, 193, 186; 108/48, 152, 108; 248/250, 239

[56] References Cited

U.S. PATENT DOCUMENTS

| | | | |
|---|---|---|---|
| 883,323 | 3/1908 | Macduff | 211/90 X |
| 1,535,741 | 4/1925 | Snodgrass et al. | 248/250 X |
| 3,194,527 | 7/1965 | Gruss | 248/250 X |
| 4,429,850 | 2/1984 | Weber et al. | 108/108 X |
| 4,508,301 | 4/1985 | Nicholson et al. | 248/250 |

*Primary Examiner*—Reinaldo P. Machado
*Assistant Examiner*—Sarah A. Lechok Eley
*Attorney, Agent, or Firm*—James G. Staples

[57] ABSTRACT

A shelving system comprising a shelf, a vertical support structure, and a shelf bracket. The shelf bracket consists of a base member and a fastener to secure the base member to a vertical support structure, a lower support ledge extending outwardly from the base member, and an upper gripper arm also extending outwardly from the base member. The upper gripper arm and lower support ledge are arranged to form an opening therebetween for the reception of a shelf. A knife edge is formed an integral part of the upper gripper arm and is arranged to penetrate and mechanically interlock with the shelf, which interlocking increases with increased cantilever loading of the shelf.

2 Claims, 1 Drawing Sheet

SHELVING SYSTEM

This application is a continuation of prior co-pending application Ser. No. 1,341, filed Jan. 8, 1987, by Harold M. Randall for Shelving System, now abandoned.

FIELD OF THE INVENTION

This invention relates to shelving and, in particular, to a do-it-yourself shelving system which is intended for installation by the ordinary consumer, such as a home dweller.

BACKGROUND OF THE INVENTION

A number of shelving systems intended for installation and use by the ordinary consumer, usually a homeowner, are currently known.

In one system is commercially available a pair of slotted rods are first attached vertically to a support structure, such as a wall, and then shelf supporting brackets are placed in appropriate slots in such fashion as to project perpendicularly outwardly from the wall a distance sufficient to underlie well over half the shelf width, or, more usually, three-fourths of the shelf width. The system is unaesthetic due to the vertical slots or similar bracket supporting structure from which the brackets project, and, also, due to the unaesthetic appearance of the brackets themselves. Usually the brackets are stamped out of sheet metal. Although they may be smoothly contoured and even colored, they are large and unsightly and, of necessity, extend downwardly from the bottom of the supported shelf a distance sufficient to cause interference with objects resting on a lower shelf. When used as a bookshelf, for example, it is not possible, assuming the height of the shelved books is nearly the vertical distance between shelves, to push the books as a group along a lower shelf.

In another system which is commercially available the vertical bracket holding structures and the bracket are eliminated and a long, continuous bracket which receives the rear edge of the shelf is employed. The bracket is secured to the vertical wall surface by suitable means, such as screws at two or more points. The bracket has two shelf holding members which extend outwardly from the back wall of the bracket and between which the rear edge of the shelf is received. Means are provided for securing the shelf to the bracket of which screws which pass through one of the shelf holding members and into engagement with the shelf are known. This system, though it may be considered an improvement over the slotted rail and bracket system earlier described, does not always provide sufficient securement force to the shelf, particularly when loads are placed on the shelf in locations near the outer edge of the shelf, which loads impose a maximum cantilever load on the bracket. Such cantilever loads ten to counteract any securement means which project upwardly from the bottom ledge of the bracket and into engagement with the bottom of the shelf. Further, such brackets are quite expensive to manufacture because they are often contoured in such a way that costly extrusion dies are required in the manufacturing process.

SUMMARY OF THE INVENTION

The present invention is a do-it-yourself shelving system which provides securement of a supported shelf to a shelf bracket at two locations, one location providing support to the shelf in such fashion that separation of the shelf from the bracket is resisted by shear forces.

A further feature of the present invention is that the resistance to shear increases with additional shelf loading, with the increase being greater the closer the effective load on the shelf is to the unsupported shelf edge.

Another feature of the inventions that, in addition to the above-described features, a third positive mechanical securement means may optionally be used so that the shelf is secured to the bracket by three separate and distinct securement means.

Other advantageous features of the invention will become apparent from the following description of the preferred embodiment of the invention.

DESCRIPTION OF THE DRAWING

The invention is illustrated more or less diagrammatically in the accompanying drawing wherein.

DESCRIPTION OF THE PREFERRED EMBODIMENT

Figure 1:
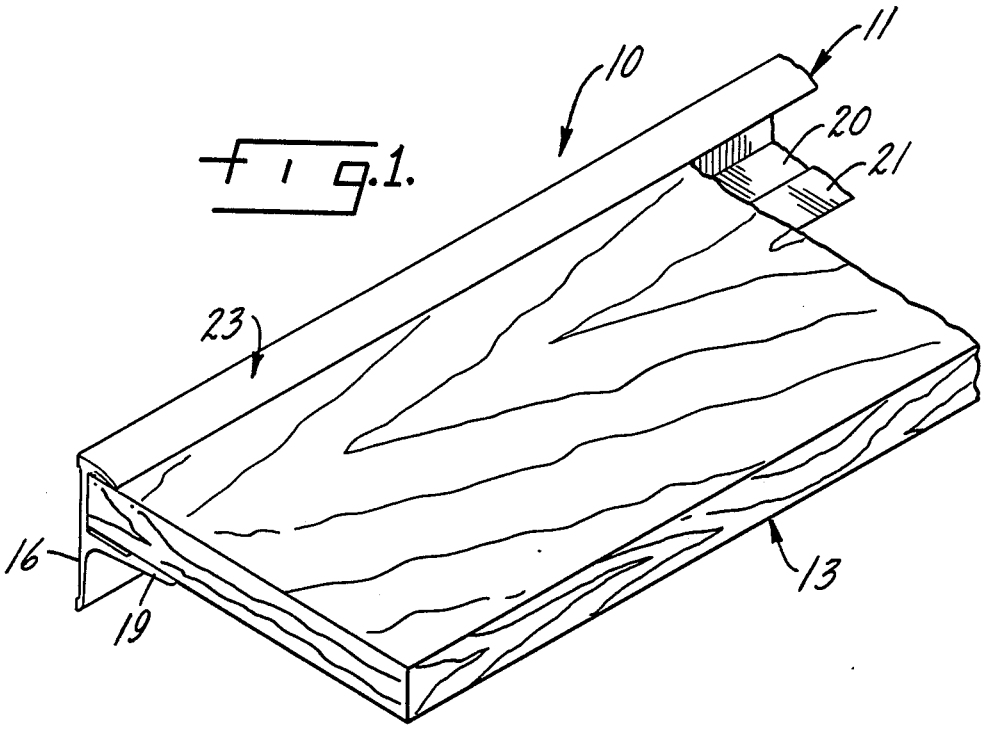
FIG. 1 is a perspective view after installation of a preferred embodiment of the do-it-yourself shelving system as it would typically appear after installation by a consumer with parts broken away for clarity.
Figure 2:
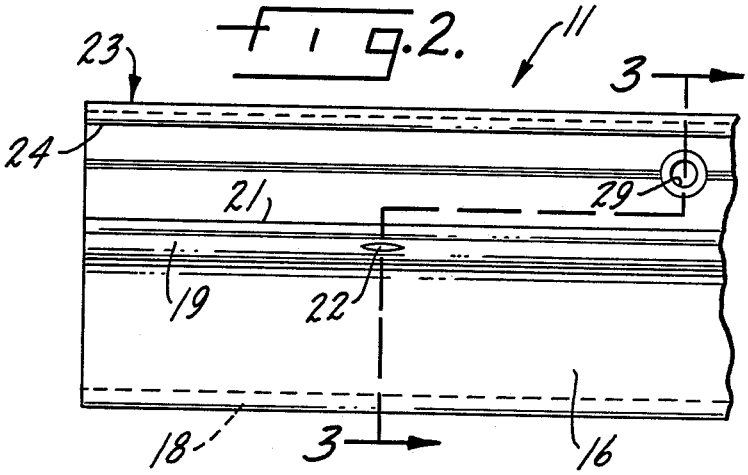
FIG. 2 is a front view of the mounting bracket of the shelf assembly of FIG. 1.

Like reference numerals will be used to refer to like parts from figure to figure in the following description of the preferred embodiment of the invention.

The shelving system of the invention is illustrated generally at 10 in FIG. 1. It consists of a shear lock bracket, indicated generally at 11, anchor means, indicated generally at 12 in FIG. 4, a shelf, indicated generally at 13, and an optional shelf locking means, indicated generally at 14.

Figure 4:
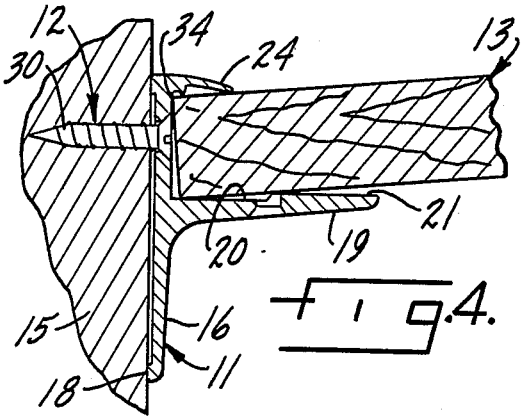
FIG. 4 illustrates in cross-section the intermediate position of a conventional shelf board during installation.
Figure 5:
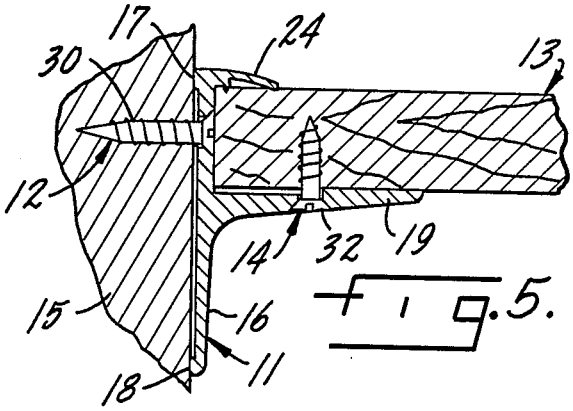
FIG. 5 illustrates in cross-section the shelving system once installation is complete.

The shear lock bracket 11 consists of a back wall 16 which terminates in upper wall pad 17 and lower wall pad 18, each of which preferably extends the length of the bracket and is arranged, as is obvious from FIGS. 4 and 5 especially, to make abutting contact with the support structure, such as a wall 15, whereby the back wall 16 of the bracket is spaced a slight distance away from the wall.

Figure 3:
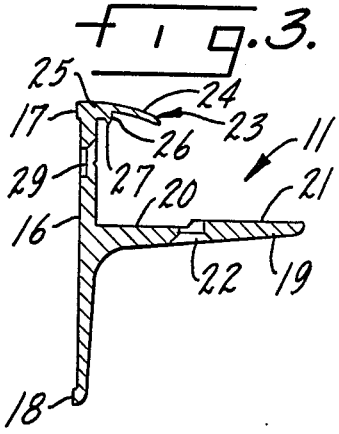
FIG. 3 is a sectional view taken substantially along the line 3—3 of FIG. 2.

A support ledge is indicated at 19, the ledge extending perpendicularly outwardly from the bracket back wall 16. The support ledge includes an inner section 20 and an outer section 21. As best seen in FIGS. 3-4, both the inner section 20 and outer section 21 are flat, with the inner section 20 being preferably, but not essentially, disposed at a lower level than outer section 21. The transition between inner and outer sections can be instantaneous; a gradual transition zone is unnecessary and does not provide any operating benefit. The use of sharp corners is preferably avoided in the extrusion process, and so some angle transition becomes economically advantageous. A plurality of apertures, one of which is indicated at 22, may be spaced at intervals along the length of the bracket which, in conjunction with screws 32 or similar fasteners, forms shelf locking means 14.

A shelf gripper arm is indicated generally at 23 in FIG. 3, the gripper arm being illustrated in its normal condition as removed from packaging and just prior to use by the consumer. The gripper arm includes an outer or front portion 24 which is sufficiently thin to be resiliently bent upwardly upon application of a prying force when a shelf is inserted as illustrated in FIG. 4. The inner or rear portion 25 of the gripper arm may be somewhat thicker than the front portion 24. A projecting member is indicated at 26, the projecting member terminating in a sharp point 27 as best seen in FIG. 3. In actuality the projecting member or tooth preferably extends the length of the bracket so that a knife edge is formed which runs the length of the bracket.

A screw aperture is indicated at 29 and a screw at 30, the aperture and screw forming anchoring means 12 for anchoring the bracket, and a shelf 13 carried thereby, to the wall 15. It will be understood that a number of anchor screws sufficient to safely distribute the load carried by the bracket will be provided along the length of the bracket.

The shear lock bracket is preferably made of aluminum which is preferably extruded. The grade of aluminum is not especially critical so long as the metal has sufficient hardness, following extrusion, to form either a knife edge 27 capable of digging into the shelf material, or at least an edge sufficient to depress the shelf material to such an extent that the lowest point on the edge 27 lies beneath the upper surface of the horizontally disposed shelf.

The use and operation of the invention is as follows.

To install the shear lock shelving system of the present invention the consumer need merely to screw the shear lock bracket 11 to the support wall 15 by the two or more wall screws 30 which pass through rear apertures 29 in the shear lock bracket 11. Leveling of the bracket 11 may be done by the naked eye or, if desired, a level may be used. The hole for the screw may be pre-drilled if the supporting wall 15 is very hard. In many instances a light tap on the wall screw 30 followed by insertion with a screwdriver will be all that is required. Thus, in many instances the only tool needed by the consumer is a screwdriver.

To insert a shelf and lock it in place, the rear edge of the shelf 13 is forced into the maw formed by shelf gripper 23 and the support ledge 19. A best seen in FIG. 4, the shelf is pushed rearwardly until the top, inner edge 34 of the shelf 13 makes contact with the front surface of back wall 16. In this position the front portion 24 of the gripper arm 23 will be deflected upwardly to its maximum deflected position as best seen in FIG. 4. At this moment, the edge 27 will be out of contact with the top surface of shelf 13, or only in light touching engagement with it.

After the installer feels the shelf edge corner 34 make contact with the back wall 16 of the bracket, the shelf is swung downwardly in a clockwise direction until its movement is stopped by flat outer section 21 of the support ledge 19. As the shelf 13 swings from the position of FIG. 4 to the position of FIG. 5, the knife edge 27 will penetrate below the upper surface of the shelf 13, either by depressing the shelf material or cutting into it. FIG. 5 illustrates the embodiment in which the knife edge is sufficiently hard and sharp in relation to the material of which the shelf is formed to cut into the shelf. The front portion 24 of gripper arm 23 will have moved from its FIG. 4 position of maximum deflection to its final deflected position of FIG. 5. By comparing the relative positions of the front portion 24 of the gripper arm with respect to the back wall 16 as illustrated in FIGS. 3 and 4, it will be noted that the final position of the shelf gripper arm 23 does not return to its normal relaxed position of FIG. 3, and hence it exerts a downwardly directed gripping or clamping force on the shelf 13. The degree of gripping or clamping force may be varied by varying the strength of material used in the manufacture of the shear lock bracket 11, the thickness of gripper arm 23, and the initial orientation of the gripper arm 23 with respect to back wall 16.

Although the gripping action provided by the gripper arm 23 and support ledge 19 substantial and may be sufficient to prevent separation of the shelf 13 from the bracket 11 under normal circumstances, the penetration of the knife edge 27 into the shelf 13 provides a positive locking action which virtually precludes separation of the shelf from the bracket. The great force resisting separation is of course the shear resistance which comes into operation when forces are applied to the shelf which tend to move the shelf in a horizontal direction away from the wall. Such forces may be either a direct pulling force or a horizontal load component derived from a load imposed from above at an angle.

It will also be noted that the greater the cantilever load on the shelf, that is, the greater the load concentration near the outer, free edge of the shelf, the greater will be the gripping action derived from the knife edge 27 engaging the shelf 13.

The preferred embodiment of this invention was mounted to a wall and thereafter a shelving board was secured to the bracket as described above. A loan was placed upon the shelving system to determine the maximum weight the shelf would support. A two foot shelf withstood weights in excess of 400 pounds before the load dislodged the shelf from the bracket.

In effect, the integrity of the shelf material becomes the only limiting resisting force.

Although the present construction provides a very large resistance to separation under normally applied forces as above described, the shelf may be readily disassembled by the consumer if it is desired to take down the shelf. By simply rotating the shelf in a counter clockwise direction from the position of FIG. 5 to the position of FIG. 4 the tooth edge 27 is disengaged from the shelf and it may then be easily pulled out.

Should it be desired to reinstall the shelf as, for example, after painting or after re-installation of the bracket at a different location, the installation procedure above described is simply repeated.

In the event further security is required following seating of the shelf in the maw of the bracket as above described, the shelf screw or screws 32 may be employed.

Although a preferred embodiment of the invention has been illustrated and described, it will at once be apparent to those skilled in the art that the invention may take other forms within the spirit and scope of the invention. Accordingly it is intended that the invention be limited solely by the hereinafater appended claims when interpreted in light of the relevant prior art.

I claim:

1. A friction gripping and shear locking shelf bracket for use with a cantileverly supported shelf which provides increasing shear locking forces with increasing cantilever loading on the shelf, said friction gripping and shear locking shelf bracket including a base member adapted to be secured to a support structure such as a wall, a combined resiliently bendable friction gripping and shear locking arm extending outwardly from the base member, a shelf support ledge extending outwardly from the base member a greater distance than the friction gripping and shear locking arm at a location below the gripping and shear locking arm, said support ledge and gripping and shear locking arm forming an opening therebetween for the reception of the rear edge portion of a shelf to be supported from the bracket, the vertical distance between (a) the distal end portion of the gripping and locking arm and (b) the support ledge being less than the thickness of the rear edge portion of a shelf to be supported, said gripping and shear locking am being bendable upwardly to a position in which the vertical distance between the distal end portion of the gripping and shear locking arm, and the support ledge, is at least equal to the thickness of the rear edge portion of a shelf to be received in the opening and supported to thereby exert a gripping force on a shelf which is adapted to be inserted in said opening, a knife edge structure projecting downwardly from the gripping and locking arm between the distal and proximate ends of the gripper arm, said knife edge structure projecting downwardly to a location beneath the upper surface of an unloaded shelf which has been inserted in the opening between the gripping and shear locking arm and the support ledge, and a fulcrum on the support ledge located distally outwardly from the knife edge structure, whereby imposition of a load on the front end portion of a cantileverly supported shelf will increase the shear locking force between the knife edge structure and the shelf.

2. A cantileverly supported shelf system having increasing shear locking forces between a shelf and a bracket in the system with increasing cantilever loading on the shelf, said system including, a shelf having a rear edge portion adapted to be gripped and cantileverly held in a friction gripping and shear locking shelf bracket, and a front edge portion, a friction gripping and shear locking shelf bracket for use with said shelf which provides increasing shear locking forces with increasing cantilever loading on the shaft, said friction gripping and shear locking shelf bracket including a base member adapted to be secured to a support structure such as a wall, a combined resiliently bendable friction gripping and shear locking arm extending outwardly from the base member, a shelf support ledge extending outwardly from the base member a greater distance than the friction gripping and shear locking arm at a location below the gripping and shear locking arm, said support ledge and gripping and shear locking arm forming an opening therebetween for the reception of the rear edge portion of a shelf to be supported from the bracket, the vertical distance between (a) the distal end portion of the gripping and shear locking arm and (b) the support ledge being less than the thickness of the rear edge portion of a shelf to be supported, said gripping and shear locking arm being bendable upwardly to a position in which the vertical distance between the distal end portion of the gripping and shear locking arm, and the support ledge, is at least equal to the thickness of the rear edge portion of a shelf to be received in the opening and supported to thereby exert a gripping force on a shelf which is adapted to be inserted in said opening, a knife edge structure projecting downwardly from the gripping and locking arm between the distal and proximate ends of the gripper arm, said knife edge structure projecting downwardly to a location beneath the upper surface of an unloaded shelf which has been inserted in the opening between the gripping and shear locking arm and the support ledge, and a fulcrum on the support ledge located distally outwardly from the knife edge structure, whereby imposition of a load on the front end portion of a cantileverly supported shelf will increase the shear locking force between the knife edge structure and the shelf.

* * * * *